US006549635B1

(12) United States Patent
Gebert

(10) Patent No.: US 6,549,635 B1
(45) Date of Patent: Apr. 15, 2003

(54) HEARING AID WITH A VENTILATION CHANNEL THAT IS ADJUSTABLE IN CROSS-SECTION

(75) Inventor: Anton Gebert, Kleinsendelbach (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 174 days.

(21) Appl. No.: 09/656,404

(22) Filed: Sep. 6, 2000

(30) Foreign Application Priority Data

Sep. 7, 1999 (DE) ..... 199 42 707

(51) Int. Cl.[7] ..... H04R 25/00
(52) U.S. Cl. ..... 381/324; 381/322
(58) Field of Search ..... 381/312, 322, 381/324, 327, 328, 380, 381, 329; 181/129, 130, 135; 600/25

(56) References Cited

U.S. PATENT DOCUMENTS 2,215,585 A * 9/1940 Huenlich ..... 181/22
5,195,139 A * 3/1993 Gauthier ..... 381/322

FOREIGN PATENT DOCUMENTS

| | | |
|---|---|---|
| CH | 681125 | 1/1993 |
| DE | OS 40 08 982 | 9/1991 |

* cited by examiner

*Primary Examiner*—Rexford Barnie
*Assistant Examiner*—P. Dabney
(74) *Attorney, Agent, or Firm*—Schiff Hardin & Waite

(57) ABSTRACT

A hearing aid device that can be directly inserted in the ear or worn with an otoplastic that can be inserted in the ear has an arrangement for adjusting the ventilation channel that is situated in the ventilation channel or at an opening of the ventilation channel. The arrangement has one or more adjustment elements that is/are positioned by electrical and/or magnetic miniature drives, initiated by corresponding operating elements or by the signal processing unit of the hearing aid device, or by programming the hearing aid device.

12 Claims, 2 Drawing Sheets

HEARING AID WITH A VENTILATION CHANNEL THAT IS ADJUSTABLE IN CROSS-SECTION

BACKGROUND OF THE INVENTION

1. Field of the Invention

The present invention relates to a hearing aid device of the type known as an "in the ear" (ITE) hearing aid, that can be directly inserted in the ear as well as to a "behind the ear" (BTE) hearing aid which has an otoplastic that is inserted in the ear, the hearing aid having at least one input transducer, a signal processing unit, an output transducer, and a ventilation channel.

2. Description of the Prior Art

The ventilation channel of a hearing aid device that can be directly inserted in the ear or of a hearing aid device having an otoplastic that can be worn in the ear serves the purpose of ventilating the ear channel, compensating the atmospheric pressure or reducing the closing effect (occlusion effect). An optimally large cross section of the ventilation channel is desired for this purpose. The ventilation channel, however, represents an acoustic bypass to the signal path via the input transducer, the signal processing unit and the output transducer of the hearing aid device, so that functions of the hearing aid device, such as a particular directional effect or a background noise reduction, can become ineffective, particularly in a loud sound situation. Moreover, feedback between the output transducer and the input transducer particularly arise in sound situations with a low level of the input signal and a high amplification of the hearing aid device, which is caused by dynamic compression, via the ventilation channel. This effect is also dependent on the cross-section of the ventilation channel. A desire to make the ventilation channel as small as possible results from these reasons. Therefore, the diameter or cross-sectional size of the ventilation channel represents a compromise between the wearing comfort and performance features of the hearing aid device. It is normally adjusted during the adaptation to the hearing aid device by means of inserting sleeves with differently sized bores for narrowing the ventilation channel to an appropriate size.

German OS 40 08 982 discloses a hearing aid device with a ventilation channel and for adaptation of the ventilation channel, a locking means In the ventilation channel for altering the cross section of the ventilation channel. The cross-section thereby can be varied between a maximum size and a complete closure with the aid of a screw driver. This adjustment possibility is carried out by the acoustician, who conventionally adjusts the opening of the ventilation channel such that transmission is free of feedback with the adapted hearing aid device In normal sound situations.

SUMMARY OF THE INVENTION

An object of the present invention is to improve the wearing comfort and the performance features of a hearing aid device having a component adapted on insertion in the ear, this component having a ventilation channel.

This object is achieved in a hearing aid device that can be directly inserted in the ear or worn in the ear with an otoplastic, having at least one input transducer, a signal processing unit, an output transducer, a ventilation channel and a moveable element for adjusting the cross-sectional size of ventilation channel operated by at least one electrical and/or magnetic miniature drive. The hearing aid device can be an ITE hearing aid, in which case the ventilation channel is in the hearing aid housing, or a BTE hearing aid, in which case the ventilation channel is in an otoplastic that is inserted in the ear.

Valves, pins, slides, flaps, adjoining discs with respective openings therein that are rotatable relative to one another, are suitable elements for adjusting the cross-sectional size of the ventilation channel, particularly by constricting or dosing the ventilation channel. The invention also encompasses a parallel arrangement of a number of individual adjustment elements, which normally are the same. Thus, a number of rotatable elements allocated to different outlets or passages can be arranged on a disc that is provided with the outlets, with one or more of the elements closing the respectively allocated outlets with other respectively allocated outlets being left open. The ratio of open and closed outlets, determines the effective cross-section of the ventilation channel. The arrangement for throttling or closing the ventilation channel can be mounted along the ventilation channel and at one or both ends.

An advantage of the inventive hearing aid device is that the cross-section of the ventilation channel can be adapted to the respective acoustic situation in a fast and simple manner. Neither tools nor a second person are necessary for adjusting the hearing aid device worn in the ear.

Normally, a relatively large cross-section of the ventilation channel is selected in order to guarantee optimal wearing comfort. In the case of particular acoustic situations, for example in a silent sound environment with simultaneous high amplification by means of the hearing aid device, the cross-section of the ventilation channel is reduced or, respectively, closed. In this way, feedback via the ventilation channel can be avoided.

There are other situations in which it is advantageous to constrict or close the ventilation channel. For example, if the hearing aid device allows functions such as directional effect or background noise reduction, the acoustic bypass, which the ventilation channel represents vis-a-vis the electrical signal path, has a negative effect on these functions. In these cases as well, its negative influence on the cited functions can be suppressed by constricting or closing the channel.

The arrangement for constricting or closing the ventilation channel is inventively operated by electrical and/or magnetic miniature drives. The simple operability and the accurate adjustability of the cross-section of the ventilation channel are advantages that result therefrom. Electrical switches, key buttons, rotating actuators etc. can be utilized as operating elements. The operating elements can thereby fulfil a number of functions at the same time and, apart from the adjustment of the ventilation channel, also can influence the parameters of the signal processing. In an exemplary embodiment of the invention, for example shifting the volume control toward a higher amplification at the same time leads to a reduction of the cross-section of the ventilation channel.

In a version of the invention, a remote control is used for operating the arrangement for constricting or closing the ventilation channel.

In a hearing aid device with a number of hearing programs, the position of the element for constricting or closing the ventilation channel is preferably coupled with (set by) the currently selected hearing program. Thus, the cross-section of the ventilation channel is also automatically adjusted corresponding to the requirements of the selected hearing program when the hearing program is changed.

In an embodiment of the invention, the arrangement for constricting or closing the ventilation channel can be set by the hearing aid device. For example, a basic adjustment of the arrangement is set in a way that is convenient for the operator when the hearing aid device is adapted to the person wearing it.

In another embodiment of the invention the signal processing unit controls the adjustment of the element for constricting or closing the ventilation channel. For this purpose, the signal processing unit analyzes and evaluates the current acoustic environment by means of a suitable algorithm and controls the corresponding adjustment of the cross-section of the ventilation channel. Detection and avoidance of the acoustic feedback channel by the ventilation channel can be included in this evaluation.

In an embodiment, the ventilation channel has a number of homogenous (i.e. identical or very similar) elements for constricting or closing the ventilation channel, these elements being arranged in parallel. Preferably, these elements are arranged on a common carrier and can be separately driven, so that some of these elements open outlets through the carrier, while others close corresponding outlets. The ratio between open and closed outlets determines the effective cross-section of the ventilation channel.

Expediently, the last described elements are manufactured by micromechanical techniques. For the micro-structuring, lithography and etching techniques, which are known from semiconductor technology, as well as other methods, such as the LIGA-technique, can be utilized. LIGA is an abbreviation for lithography, electroforming and shaping techniques. Very small three-dimensional structures can be produced with such micromechanical techniques and can be combined to form the arrangement for constricting and closing the ventilation channel. The generation of power for operating these elements is based on various principles, such as the piezo-effect, the shape memory effect or on electrostatic forces. Such production techniques lead to a cost reduction given a large scale manufacture, in particular.

DESCRIPTION OF THE PREFERRED EMBODIMENTS

Figure 1:
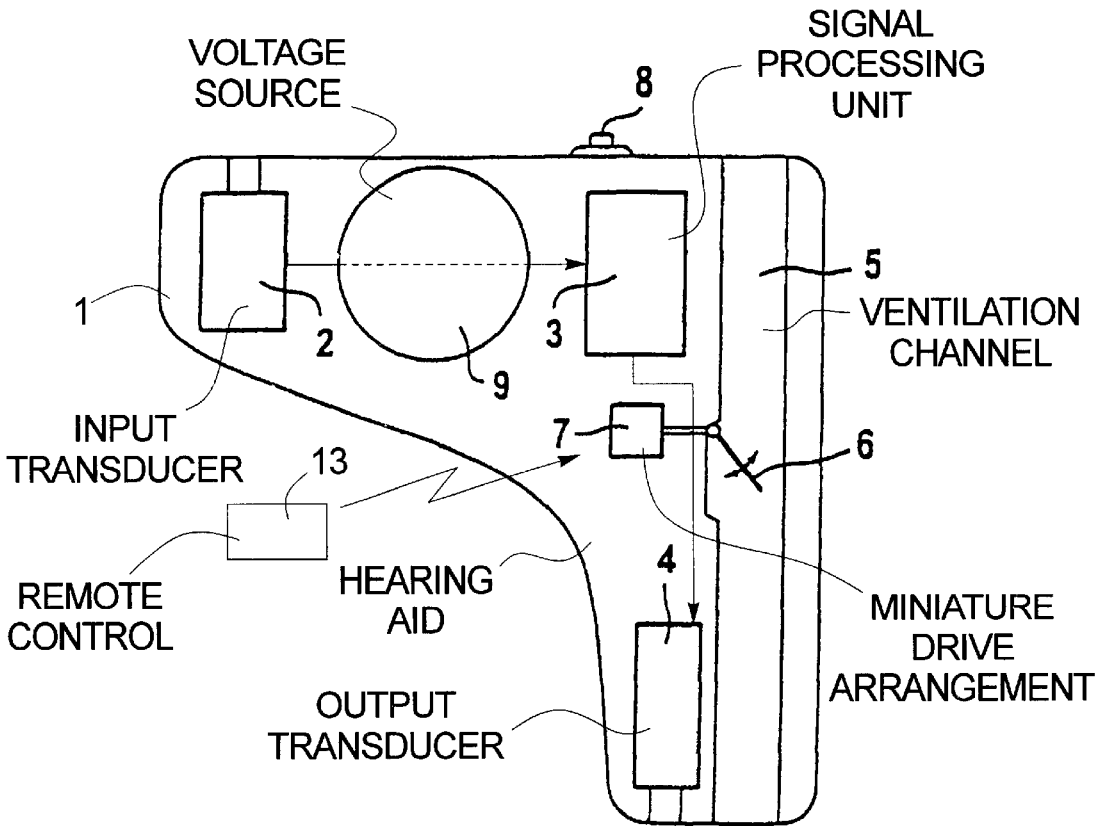
FIG. 1 is a schematic illustration in block diagram form of a hearing aid constructed and operating in accordance with the principles of the present invention, in a first embodiment wherein the cross-section of the ventilation channel is adjusted by a throttle flap.

FIG. 1 shows an inventive hearing aid device 1 with an input transducer 2, a signal processing unit 3, an output transducer 4, a ventilation channel 5, an operating element 8 and a voltage source 9. The input transducer 2, the signal processing unit 3 and the output transducer 4 are connected together in an electrical signal path, schematically indicated by arrows. An acoustic signal is supplied to the ear via the input transducer 2, the signal processing unit 3 and the output transducer 4 as well as (unavoidably) via the ventilation channel 5. Therefore, the ventilation channel 5 represents a bypass to the electroacoustic signal path through the hearing aid device 1. In specific acoustic situations, for example when the acoustic amplification of the hearing aid device is low due to a noisy sound environment, this bypass is dominant vis-a-vis the electrical signal path through the hearing aid device 1. This can have the effect that specific functions of the hearing aid device, such as a desired directional effect or a background noise reduction, can only be achieved in a limited manner. Moreover, the ventilation channels can cause feedback between the output transducer 4 and the input transducer 2.

The inventive hearing aid device 1 in the embodiment of FIG. 1 has a throttle flap 6 in the ventilation channel 5 in order to avoid such effects. The flat 6 can close the ventilation channel 5 entirely or partially. An electromagnetic miniature drive 7 serves the.purpose of adjusting the position of the throttle flap 6. The hearing aid device 1 of FIG. 1 can be selectively operated according to a selected one of a number of hearing programs with the aid of an operating element 8 that is fashioned as a key switch. The signal processing unit 3 and the electromagnetic miniature drive 7 adjust the throttle flap 6 depending on the selected hearing program. Alternatively, the miniature drive 7 can be operated wirelessly from a remote control 13.

Moreover, the signal processing unit 3 of the hearing aid device 1 is able to recognize extremely loud or silent sound situations as well as feedback and to thereby correct the adjustment of the throttle flap 6.

In the inventive hearing aid device 1, the adjustment of the throttle flap 6 can also be effected by operating the volume regulator (not shown). The higher the amplification is selected the more the ventilation channel 5 is closed. Thereby, feedback can be avoided with respect to loud sound events and high amplification.

Figure 2:
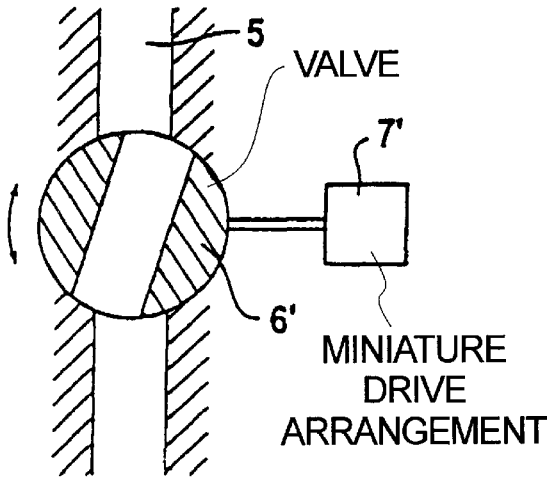
FIG. 2 is a sectional view of a further embodiment in accordance with the invention for adjusting the cross-section of the ventilation channel, in the form of a valve.

In another inventive embodiment, a valve 6' shown in FIG. 2 is provided as the element for constricting or closing the ventilation channel 5. The adjustment also ensues in this embodiment via an electromagnetic miniature drive 7'. This version is particularly characterized by its robustness and exact adjustability.

Figure 3:
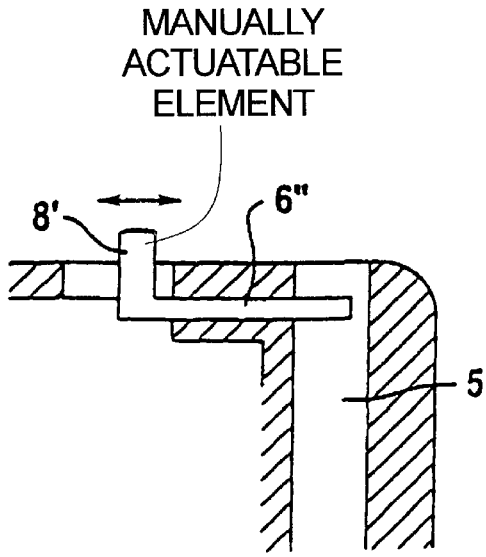
FIG. 3 is a sectional view of a further embodiment in accordance with the invention for adjusting the cross-section of the ventilation channel, employing a manually actuatable element.

In another inventive embodiment, a manually actuatable element 8' shown in FIG. 3 is providing for sliding movement to adjust the cross-sectional area of the ventilation channel 5.

FIG. 3 shows a carrier 11, which is inserted into the ventilation channel 5 and which is provided with outlets 10, with a number of arrangements 6''' which are operable in parallel to effect opening and closing of the ventilation channel 5. Rotatable closure elements 12 that are mounted in the carrier 11 thereby enable the (preferably) complete opening or closing of respective outlets 10 that are allocated to the closure elements 12. The closure elements 12 can be individually driven, so that normally some of the outlets are closed, whereas other outlets are open. The effective cross-section of the ventilation channels can be adjusted dependent on the ratio of open and closed outlets 10. The carrier 11 is preferably composed of semiconductor material, and the closure elements 12 are introduced therein using micromechanical techniques. The closure elements 12 are operated by electromagnetic forces, initiated by operating a switch, for example.

Figure 4:
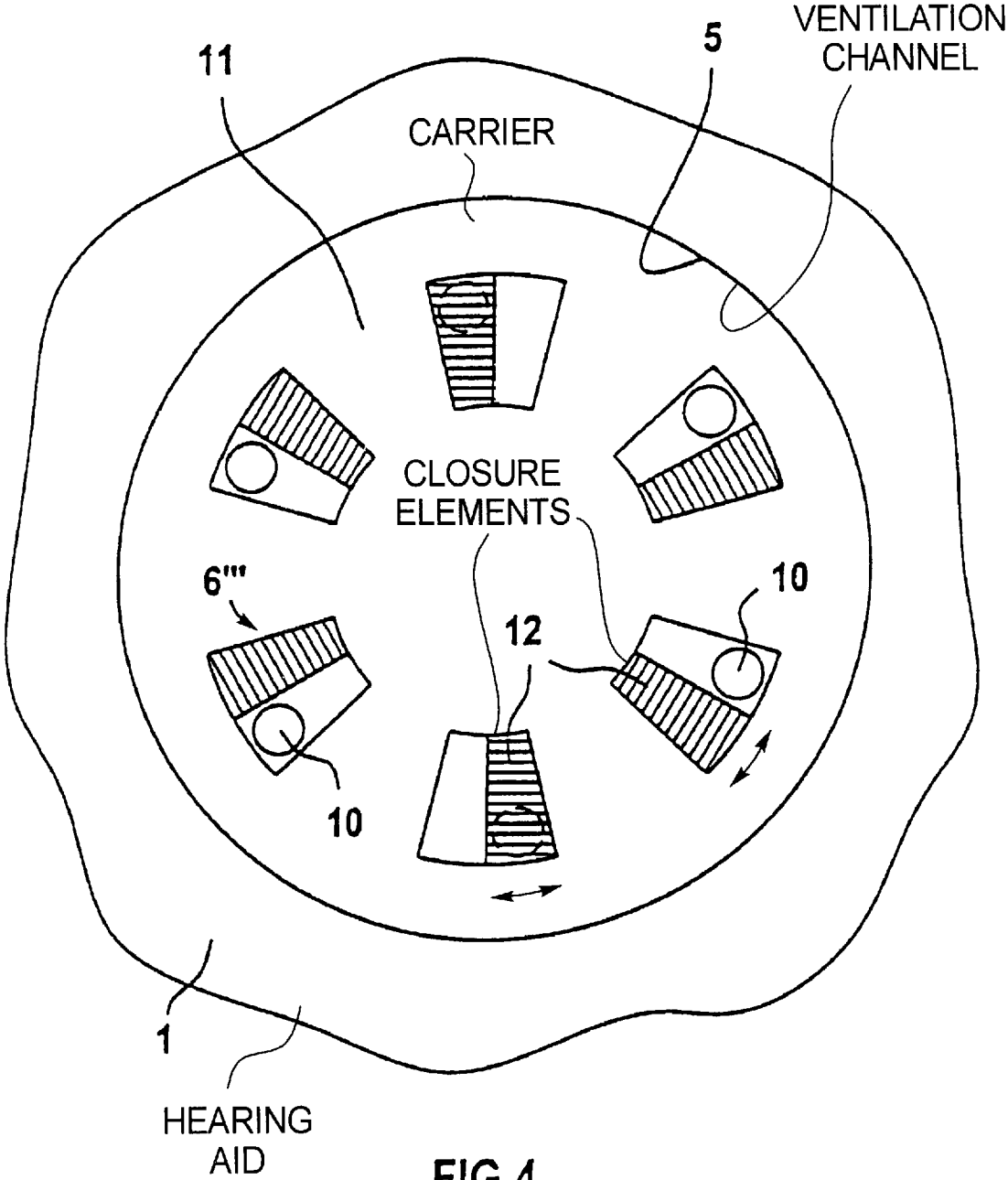
FIG. 4 is a schematic illustration of a further embodiment of an arrangement for adjusting the cross-section of the ventilation channel in accordance with the invention, in the form of a carrier with a number of outlets, and closure elements respectively allocated to the outlets.

FIG. 4 shows a carrier 11, which is inserted into the ventilation channel 5 and which is provided with outlets 10, with a number of arrangements 6''' which are operable in parallel to effect opening and closing of the ventilation channel 5. Rotatable closure elements 12 that are mounted in the carrier 11 thereby enable the (preferably) complete opening or closing of respective outlets 10 that are allocated to the closure elements 12. The closure elements 12 can be individually driven, so that normally some of the outlets are closed, whereas other outlets are open. The effective cross-section of the ventilation channels can be adjusted dependent on the ratio of open and closed outlets 10. The carrier 11 is preferably composed of semiconductor material, and the closure elements 12 are introduced therein using micromechanical techniques. The closure elements 12 are operated by electromagnetic forces, initiated by operating a switch, for example.

Although various minor modifications might be suggested by those skilled in the art, it should be understood that my wish to embody within the scope of the patent warranted hereon all such modifications as reasonably and properly come with the scope of my contribution to the art.

I claim as my invention:

1. A hearing aid device comprising:

an output transducer;

a housing in communication with said output transducer and being adapted for insertion in to an ear;

an input transducer and a signal processing unit, said input transducer, said signal processing unit and said output transducer being connected together in an electrical signal path;

a ventilation channel proceeding through said housing and communicating an ear interior with an ear exterior, said ventilation channel having an effective cross-sectional size; and at least one movable element disposed in said ventilation channel, said at least one movable element setting said effective cross-sectional size of said ventilation channel dependent on a position of said movable element in said ventilation channel, and a drive arrangement in said housing connected to said movable element for positioning said movable element in said ventilation channel, said drive arrangement being selected from the group consisting of miniature electrical drives and miniature magnetic drives.

2. A hearing aid device as claimed in claim 1 wherein said drive arrangement is connected to said signal processing unit and is operated by said signal processing unit for automatic adjustment of said effective cross-sectional size of said ventilation channel.

3. A hearing aid device as claimed in claim 2 wherein said signal processing unit identifies an acoustic situation and controls said drive arrangement to set said effective cross-sectional size of said ventilation channel dependent on said acoustic situation.

4. A hearing aid device as claimed in claim 2 wherein said signal processing unit is operable according to a hearing program selected from among a plurality of available hearing programs, and wherein said signal processing unit controls said drive arrangement to position said movable element to set said effective cross-sectional size of said ventilation channel dependent on said hearing program.

5. A hearing aid device as claimed in claim 1 further comprising at least one manually actuatable operating element for operating said drive arrangement to selectively set said cross-sectional size of said ventilation channel.

6. A hearing aid device as claimed in claim 1 further comprising a remote control in wireless communication with said drive arrangement for controlling said drive arrangement to operate said movable element to set said effective cross-sectional size of said ventilation channel.

7. A hearing aid device as claimed in claim 1 wherein said signal processing unit is programmable, and wherein said effective cross-sectional size of said ventilation channel is set during programming of said signal processing unit.

8. A hearing aid device as claimed in claim 1 comprising a plurality of adjustment elements, operable in parallel, disposed in said ventilation channel and being collectively movable to set said effective cross-sectional size of said ventilation channel.

9. A hearing aid device as claimed in claim 8 wherein said plurality of adjustable elements are at least partially composed of components manufactured by micro-manufacturing techniques.

10. A hearing aid device as claimed in claim 9 comprising a carrier having a plurality of openings therein disposed in said ventilation channel, and wherein said adjustable elements comprise a plurality of closure elements respectively allocated to said openings and being individually movable by said drive arrangement to close a selected number of said openings to set said effective cross-sectional size of said ventilation channel.

11. A hearing aid device as claimed in claim 1 wherein said housing also contains said input transducer and said signal processing unit.

12. A hearing aid device as claimed in claim 1 wherein said housing comprises an otoplastic.

* * * * *